United States Patent [19]

Prohazka

[11] 4,232,636

[45] Nov. 11, 1980

[54] MAINTENANCE PLATFORM BUILT UPON RETRACTABLE SUPPORT BEAMS

[75] Inventor: George J. Prohazka, Simsbury, Conn.

[73] Assignee: Combustion Engineering, Inc., Windsor, Conn.

[21] Appl. No.: 28,036

[22] Filed: Apr. 9, 1979

[51] Int. Cl.[3] ..... F22G 5/00

[52] U.S. Cl. ..... 122/479 R; 182/128; 182/36

[58] Field of Search ..... 122/479 R, 494; 432/3; 182/128, 82, 223, 36

[56] References Cited

U.S. PATENT DOCUMENTS 4,058,184 11/1977 Stuart et al. ..... 182/128

*Primary Examiner*—Anthony V. Ciarlante

*Attorney, Agent, or Firm*—Wayne H. Lang

[57] ABSTRACT

A maintenance platform for a boiler-furnace that permits safe and ready access to its normally inaccessible upper parts and integral superheater. The maintenance platform is installed in the furnace, below the superheater on a horizontally movable support whereby said support may be selectively moved across said furnace or stored laterally adjacent thereto.

7 Claims, 2 Drawing Figures

MAINTENANCE PLATFORM BUILT UPON RETRACTABLE SUPPORT BEAMS

BACKGROUND OF THE INVENTION

Figure 1:
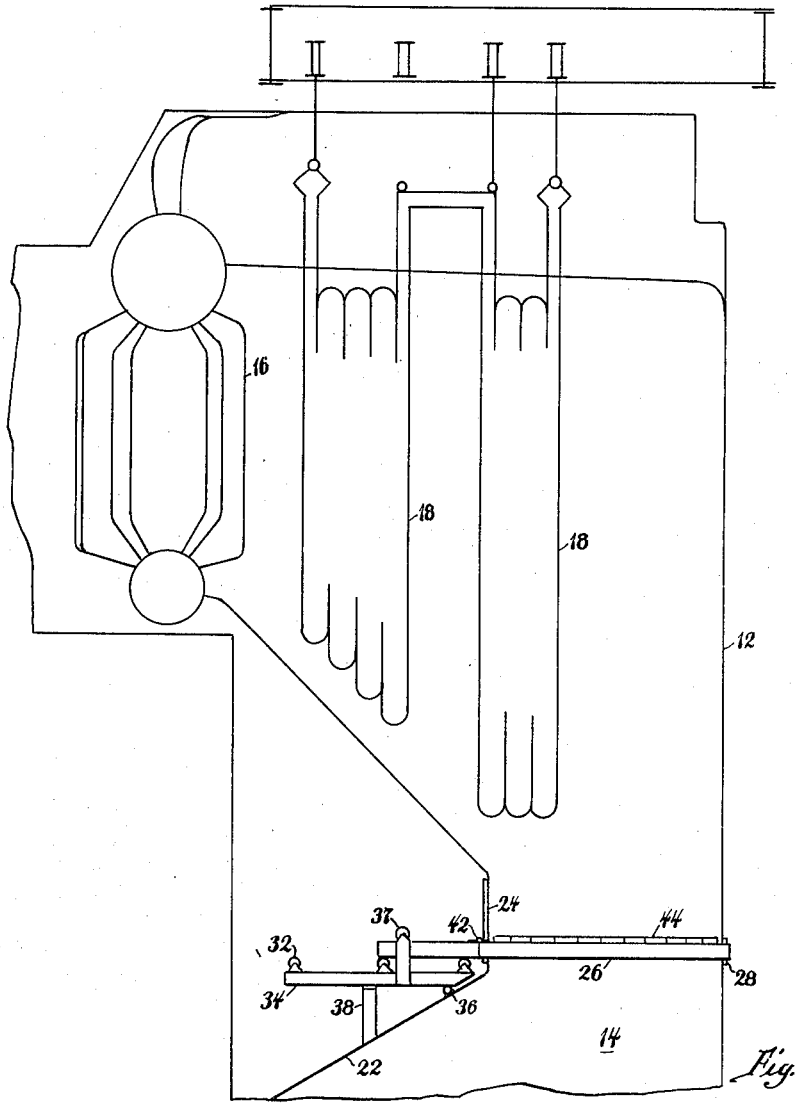

This invention relates generally to boiler-furnaces of the tubular panel type having superheaters suspended across the upper portion thereof. Access to a superheater suspended across the upper portion of a large furnace is both difficult and dangerous because of its inaccessability and because of the great height of the furnace involved. Frequently, access platforms are suspended from cables that are anchored in the roof of the furnace, however such platforms are unsteady and thereby provide an insecure support for workmen that may be suspended approximately 100 feet above the furnace floor. Moreover, furnaces must be shut down for a long period of time to permit cooling before workmen may freely enter the furnace to build the scaffolding necessary so repairs may be slow and expensive.

Accordingly, the down time of furnaces being repaired, the costs of repair, and the danger associated therewith together constitute problems that rank high in the cause of furnace maintenance.

SUMMARY OF THE INVENTION

In accordance with this invention, I therefore provide a movable maintenance platform that may readily be installed through the walls of a furnace housing, below the superheater thereof, to provide a stable base on which workmen may operate to service the superheater or other boiler parts. Essentially, the platform comprises a series of horizontal beams, each supported for lateral movement across said furnace and beneath the superheater. The beams are adapted to be moved horizontally across the furnace housing on a sliding support at one side to a fixed support on the other side where said beams provide a stable base for a temporary maintenance platform subjacent the superheater.

The sliding supports for the parallel beams are mounted on the furnace walls so they move along with thermal expansion that results from variations of temperature. This condition allows the beams to be inserted before the furnace walls have cooled, thereby reducing down time. Moreover, in their retracted position and temporary maintenance beams are stored outside the furnace in the "nose arch" of the furnace, an area not ordinarily used for any other function.

THE DRAWING

Figure 2:
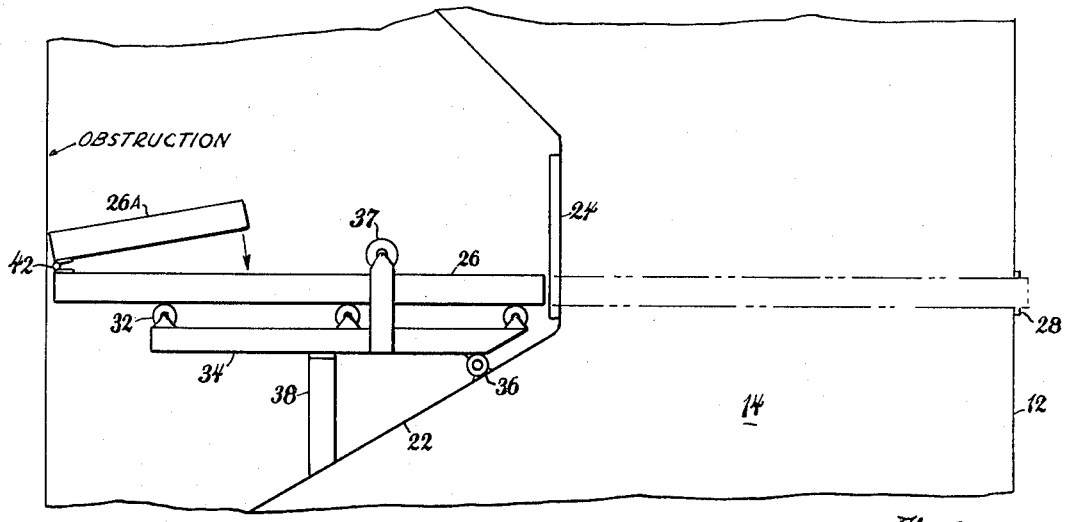

FIG. 1 shows a restricted upper part of a boiler furnace having a temporary access platform constructed according to this invention, and FIG. 2 shows an enlarged detail of the temporary access platform as withdrawn into the "nose arch" of the furnace.

THE SPECIFICATION

In the apparatus of the invention, a boiler having waterwalls 12 encloses a combustion chamber 14 that includes a conventional firing unit not here shown. A boiler bank 16 is adapted to absorb the heat of combustion while a superheater 18 is frequently installed between the combustion chamber and the boiler bank 16 to provide additional surface for the absorption of heat. Hot gases generated by the firing unit flow upward through the combustion chamber and then pass over the superheater and boiler bank and other auxiliary generating equipment before they are exhausted to the atmosphere.

A nose projection 22 formed by inclined waterwall tubes extends into the combustion chamber to aid in directing the flow of combustion gases through the unit while simultaneously shielding the superheater 18 from the deleterious effects of radiant heat given off by the combustion of fuel in the lower part of the furnace.

A boiler of the type defined herein having a superheater at the upper end thereof has severe maintenance problems because of the difficulty in obtaining access thereto. Frequently, access is obtained to the superheater by suspending work platforms on cables anchored in the furnace roof. These platforms are unsteady and workers tend to become uncomfortable on them, especially when they are suspended as much as 100 feet above the furnace floor. Moreover, such suspended platforms are cumbersome, slow to be arranged and they require excessive down-time since each boiler-furnace must be completely cool before workmen may enter to set up any platforms for maintenance and repair.

In this invention, I provide for a temporary platform that crosses the restricted portion of a boiler-furnace immediately subjacent the superheater at a throat portion caused by the inclined waterwalls or "nose". Inasmuch as the nose of the furnace defines a restricted portion in the combustion chamber, the horizontal distance across the furnace is the smallest and the shortest beams may be used to bridge the boiler at this point. Openings with removable doors 24 are therefore provided here to permit entry inside the combustion chamber of the horizontal beams 26 and the necessary workmen. In accordance with this invention, a series of laterally adjacent beams 26 are extended across the throat of the combustion chamber to a fixed support 28 on an opposite side wall thereof whereby the beams may be firmly supported at opposite ends. The beams may be moved manually and they are locked or pinned to the wall portion to preclude accidentially coming loose.

A roller frame 34 that supports the beams 26 is mounted on the outer face of the inclined waterwalls of the nose 22. The frame 34 includes a series of rollers 32 that are mounted thereon on horizontal alignment with the opening in the throat of chamber 14 whereby the beams, when resting on the rollers, may be projected laterally through said opening to the fixed support 28. A door 24 is available to completely enclose the wall opening when the beams 26 are withdrawn therefrom. An upper roller 37 carried by frame 34 is spaced above the roller 32 to carry the upward thrust of the extended beam 26 between rollers 32 and 37, as it is being moved outward across chamber 14. The lower rollers 32 and the upper roller 37 thus provide a continuous bearing support for the beam 26 therebetween.

To compensate for the thermal movement of the waterwalls whereby the top of rollers 32 are at all times aligned with the opening 24, the end of frame 34 adjacent opening 24 is pivotally attached at 36 to the inclined wall, while the other end of frame 34 is supported on a pedestal 38 that extends vertically from the inclined furnace wall 22. Inasmuch as one end of the frame 34 is free to move relative to the vertical pedestal 38 while the other end is pivotally attached at 36 to the walls of the unit, thermal variations are readily contained and there is no distortion of the frame. Moreover, this allows beams 26 to be moved laterally across the throat of the boiler, when the boiler is still hot, thereby reducing boiler "down time".

The beams 26 must obviously be long enough to be supported by upper and lower rollers 32–37 at one end while reaching across the furnace to support 28. In many cases, an obstruction outside the furnace precludes the use of a unitary beam 26 that may be retracted completely from the furnace. Therefore, the beams are built up of complementary sections that may be hinged, telescoped, or pivoted out of the way when said beams are retracted in the manner shown by FIG. 2.

The form illustrated in FIG. 2 includes a beam 26 having an end portion 26A pivotally attached thereto by a hinge device 42. As the beams 26 are retracted from the boiler (furnace) the ends 26A are simply folded up to avoid the obstruction and stored on the nose 22.

The number of beams 26 required for any unit depends upon the size of the unit and the scope of the job. Moreover, a series of planks 44 are usually placed across the beams 26 to provide a more complete platform for workmen subjacent the superheater. The planks 44 may be withdrawn from the furnace chamber and stored along with beams 26 on nose 22.

When work on the superheater is complete, it is only necessary to remove the planks 44, slide the beams laterally back to support frame 34, and place a closure door over the openings 24 at the side of the boiler.

I claim:

1. A vapor generating unit having waterwalls that enclose an upright combustion chamber, a nose projection in one of said waterwalls inclined to extend obliquely into said chamber to form a restriction between upper and lower parts thereof, a superheater in the upper part of the combustion chamber, an opening in said waterwall forming the nose projection, a platform adapted to traverse the opening and extend across the restricted portion of the combustion chamber, said platform including an elongate beam, and support means on the inclined waterwall adapted to support said beam for lateral movement through said opening from a position outside the combustion chamber to a position that bridges the restricted portion thereof.

2. A vapor generating unit as defined in claim 1 wherein the support means on the inclined waterwall includes a lateral support beam, and means pivotally attaching an end of the lateral support beam to the inclined wall while a free end extends outward therefrom.

3. A vapor generating unit as defined in claim 2 including a support pedestal subjacent the lateral support beam adapted to slidably support the free end of said support beam.

4. A vapor generating unit as defined in claim 3 wherein the support means includes upper and lower roller support members spaced apart to accept the elongate beam therebetween whereby it may be moved horizontally through said opening.

5. A vapor generating unit as defined in claim 4 wherein a wall of said combustion chamber lying opposite said opening includes means that supports the end portion of each elongate beam.

6. A vapor generating unit as defined in claim 1 wherein the elongate beams are comprised of longitudinally complementary sections that together provide maximum elongation when installed across the throat of said unit and require a minimum of storage space when withdrawn therefrom.

7. A vapor generating unit as defined in claim 6 wherein the complementary sections of the elongate beams are hinged together to permit vertical displacement thereof.

* * * * *